US009939215B2

(12) United States Patent
Gzym et al.

(10) Patent No.: US 9,939,215 B2
(45) Date of Patent: Apr. 10, 2018

(54) AUTOMATED CLEANING SYSTEM

(71) Applicant: NLB Corp., Wixom, MI (US)

(72) Inventors: Cam Gzym, Ann Arbor, MI (US); Donald Anthony Wojciechowski, III, Redford, MI (US)

(73) Assignee: NLB CORP., Wixom, MI (US)

( * ) Notice: Subject to any disclaimer, the term of this patent is extended or adjusted under 35 U.S.C. 154(b) by 658 days.

(21) Appl. No.: 14/477,410

(22) Filed: Sep. 4, 2014

(65) Prior Publication Data

US 2015/0068563 A1 Mar. 12, 2015

Related U.S. Application Data

(60) Provisional application No. 61/874,549, filed on Sep. 6, 2013.

(51) Int. Cl.

| | |
|---|---|
| ***F28G 15/04*** | (2006.01) |
| ***F28G 15/00*** | (2006.01) |
| ***F28G 15/02*** | (2006.01) |
| ***F28G 1/16*** | (2006.01) |
| ***F28G 15/08*** | (2006.01) |

(52) U.S. Cl.

CPC ..... *F28G 15/04* (2013.01); *F28G 1/163* (2013.01); *F28G 15/003* (2013.01); *F28G 15/02* (2013.01); *F28G 15/08* (2013.01)

(58) Field of Classification Search

CPC ..... F28G 15/04; F28G 15/003; F28G 15/08; F28G 1/163; F28G 15/02

See application file for complete search history.

(56) References Cited

U.S. PATENT DOCUMENTS

| | | | | | |
|---|---|---|---|---|---|
| 4,498,427 | A * | 2/1985 | Todd | B05B 15/00 | 122/290 |
| 4,805,653 | A * | 2/1989 | Krajicek | B08B 9/0323 | 134/166 C |
| 5,002,120 | A * | 3/1991 | Boisture | B65H 75/4402 | 122/391 |
| 5,018,544 | A * | 5/1991 | Boisture | B08B 9/0323 | 134/111 |
| 5,022,463 | A * | 6/1991 | Boisture | B65H 75/4402 | 122/379 |
| 5,031,691 | A * | 7/1991 | Boisture | B65H 75/4402 | 122/379 |
| 5,129,455 | A * | 7/1992 | Boisture | B65H 75/4402 | 122/379 |
| 5,261,600 | A * | 11/1993 | Cradeur | B08B 9/0321 | 122/392 |
| 5,322,080 | A * | 6/1994 | Rankin | B05B 1/14 | 134/167 C |

(Continued)

*Primary Examiner* — Michael Barr
*Assistant Examiner* — Benjamin L Osterhout
(74) *Attorney, Agent, or Firm* — Carlson, Gaskey & Olds, P.C.

(57) ABSTRACT

An automated cleaning system according to an exemplary aspect of the present disclosure includes, among other things, an X-Y positioning system configured to position a lance guide relative to an element to be cleaned. The X-Y positioning system is remotely operated. The system further includes a lance in communication with the lance guide, a drive system configured to drive the lance relative to the element to be cleaned, and a reel configured to manage a slack in the lance.

20 Claims, 8 Drawing Sheets

(56) References Cited

U.S. PATENT DOCUMENTS

| | | | | | |
|---|---|---|---|---|---|
| 5,377,913 | A * | 1/1995 | Van Der Woude | B08B 9/049 | 165/95 |
| 5,451,002 | A * | 9/1995 | Amuny | B08B 9/0323 | 122/379 |
| 5,782,209 | A * | 7/1998 | Vandenberg | F22B 37/483 | 122/379 |
| 5,813,370 | A * | 9/1998 | Owen | F22B 37/483 | 122/382 |
| 6,681,839 | B1 * | 1/2004 | Balzer | F28G 1/163 | 122/379 |
| 8,057,607 | B2 * | 11/2011 | Gardner | B08B 9/04 | 134/166 C |
| 8,800,575 | B2 * | 8/2014 | Angel | E21B 17/085 | 118/305 |
| 2009/0255557 | A1 * | 10/2009 | Gardner | B08B 9/04 | 134/18 |
| 2010/0126540 | A1 * | 5/2010 | Geppert | B08B 9/0433 | 134/166 C |
| 2012/0067370 | A1 * | 3/2012 | Crock | B08B 9/043 | 134/6 |
| 2013/0220389 | A1 * | 8/2013 | Snow | B08B 9/032 | 134/166 C |

* cited by examiner

AUTOMATED CLEANING SYSTEM

RELATED APPLICATIONS

This application claims the benefit of U.S. Provisional Application No. 61/874,549, filed Sep. 6, 2013, the entirety of which is herein incorporated by reference.

BACKGROUND

This application relates to a lance tube cleaning system. Lances are commonly used to clean tubes, such as those that may be found in heat exchangers.

With reference to FIG. 1, which illustrates a known cleaning system 10, a plurality of lances 12 equipped with cleaning nozzles are attached to a lance guide mechanism 14, and a drive system 16 drives the lances 12 into a plurality of tubes 18 within a heat exchanger 20. In this example, the lances 12 are provided with a high pressure fluid from a source 21.

Generally, an operator 22 is required to manually position the lance guide 14 relative to the tubes 18. This requires the operator to be standing relatively close to a high pressure fluid. Further, an additional operator may be required to manage the slack 24 of the flexible lances upstream of the drive system 16.

SUMMARY

An automated cleaning system according to an exemplary aspect of the present disclosure includes, among other things, an X-Y positioning system configured to position a lance guide relative to an element to be cleaned. The X-Y positioning system is remotely operated. The system further includes a lance in communication with the lance guide, a drive system configured to drive the lance relative to the element to be cleaned, and a reel configured to manage a slack in the lance.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

The drawings can be briefly described as follows:

FIG. 1 schematically illustrates a known cleaning system.

FIG. 2 schematically illustrates an automated cleaning system according to this disclosure, which includes a reel assembly and a drive system, among other components.

DETAILED DESCRIPTION

Figure 1:
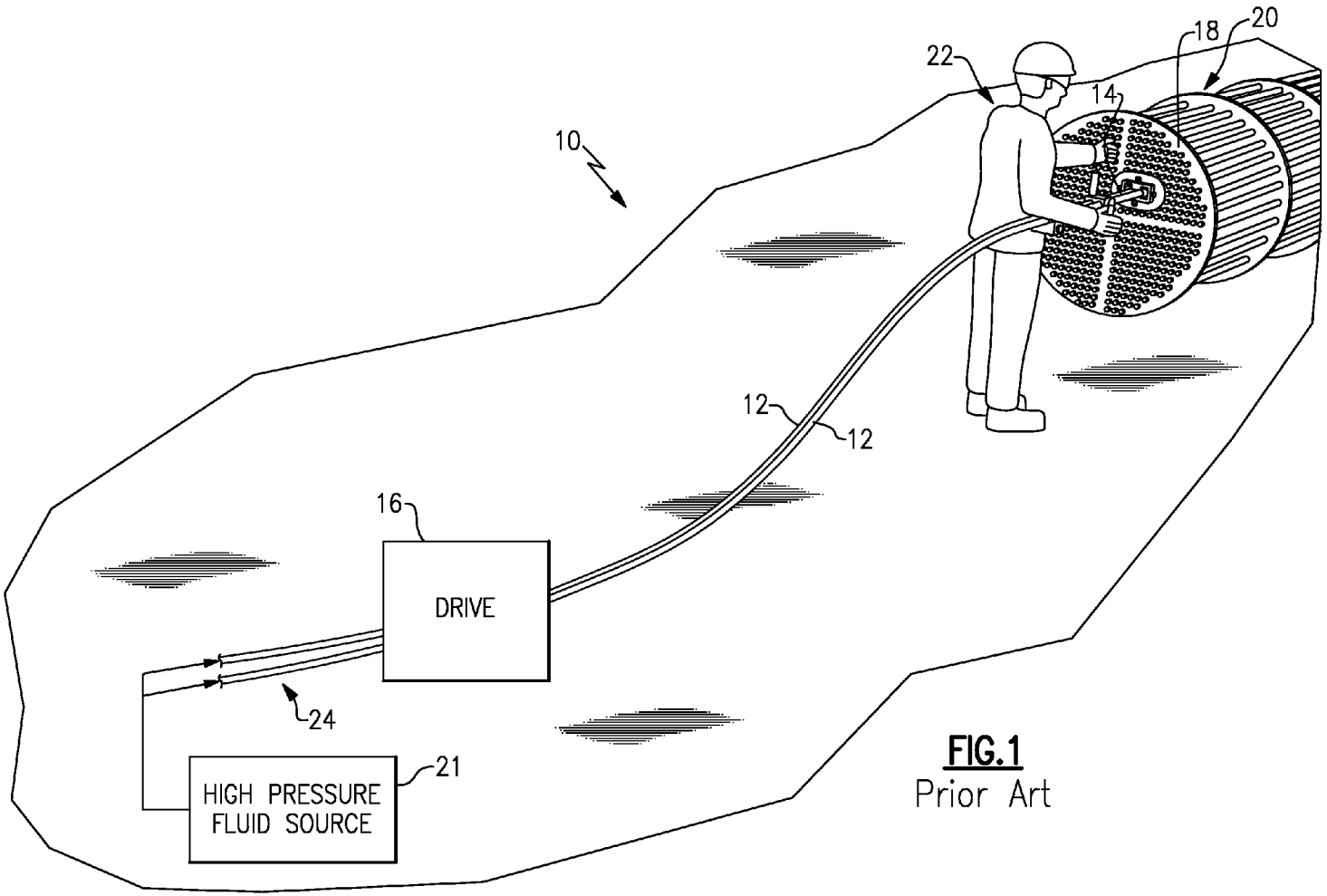
FIG. 1 Prior Art
Figure 2:
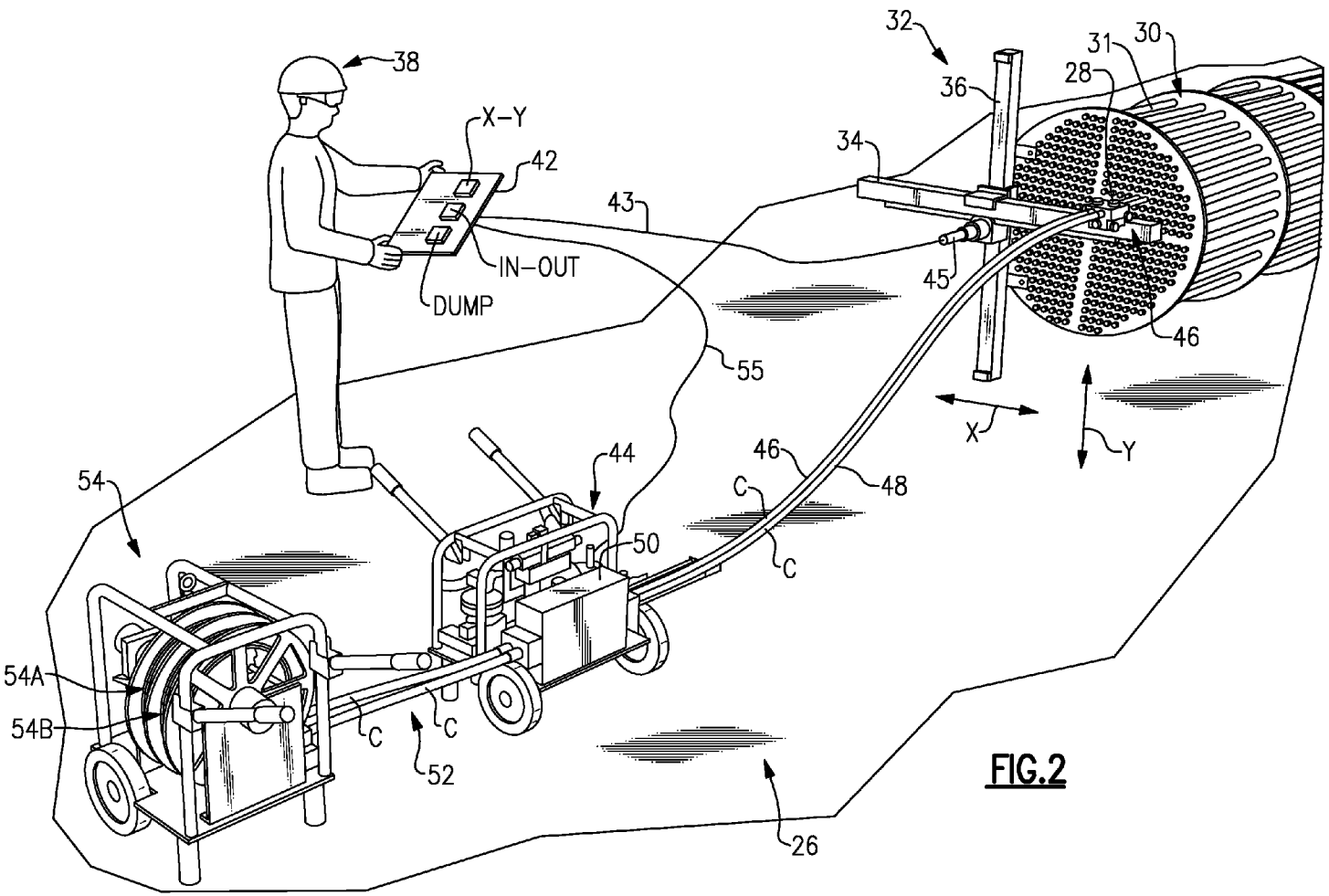

This application relates to a lance tube cleaning system. FIG. 2 illustrates an example automated cleaning system 26 according to this disclosure. The cleaning system 26 includes a lance guide 28 mounted relative to a heat exchanger 30 by way of an X-Y positioning system 32. In this example, the lance guide 28 is mounted to a horizontal support 34 (or, X-support) which is slidably mounted to a vertical support 36 (or, Y-support).

As illustrated, the vertical support 36 is directly fastened to the heat exchanger 30. The X-Y positioning system 32 may be connected to other items besides heat exchangers. In these examples, there may be adapters configured to fit the X-Y positioning system 32 relative to the particular item to be cleaned.

The X-Y positioning system 32 is configured to allow an operator 38 to remotely position the lance guide 28 relative to the various tubes 31 of the heat exchanger 30. In one example, the lance guide 28 is fixedly mounted at one end 40 of the horizontal support 34. The horizontal support 34 is configured to move horizontally relative (e.g., in the X-direction) to the vertical support 36 by way of a first actuator. The horizontal support 34 is further configured to move vertically (e.g., in the Y-direction, which is perpendicular to the X-direction) along the vertical support 36 by way of another actuator.

An operator 38 can remotely control the position of the lance guide 28 by sending the appropriate signals to the actuators in the X-Y positioning system 32. In one example, the operator 38 is provided with a remote control 42, which in the example includes a plurality of air-actuated (or fluid actuated) lines connected relative to the X-Y positioning system 32. The control of the X-Y positioning system is schematically illustrated at the "X-Y" button on the remote control 42. A line 43 runs from the remote control 42 to at least one pneumatically operated actuator 45 to effect the X-Y movement of the lance guide 28.

In the example of FIG. 2, the vertical support 36 is fixed relative to the heat exchanger 30. In other examples, such as that of FIGS. 6A-6B, the horizontal support may be fixed to the heat exchanger 30.

The cleaning system 26 further includes a drive system 44 configured to drive a plurality of lances 46, 48 into the tubes 31 in the heat exchanger 30. While two lances 46, 48 are illustrated, it should be understood that any number of lances can be provided. In one example, the lances 46, 48 are flexible, and are contained within a flexible conduit C (or guide) extending between a reel 54, drive unit 50, and the lance guide 28, in part to protect, guide, and contain the lances 46, 48 from obstructions in the work area around the heat exchanger 30. The lances 46, 48 are configured to be driven by a belt drive system 50. The operator 38 may remotely control the belt drive system 50 to control the in-and-out movement of the lances 46, 48 relative to the heat exchanger 30 (e.g., illustrated as an "IN-OUT" control). In this example the remote control 42 is in fluid communication with the belt drive system 50 by way of a line 55. The belt drive system 50 is controllable pneumatically, in this example.

The slack 52 in the lances 46, 48 upstream of the drive system 44 is taken up (e.g., wound) by a reel 54 in order to manage the lances 46, 48 and prevent tangling. In this example, there are two lances 46, 48, and therefore the reel 54 includes two spool sections 54A, 54B.

Figure 3:
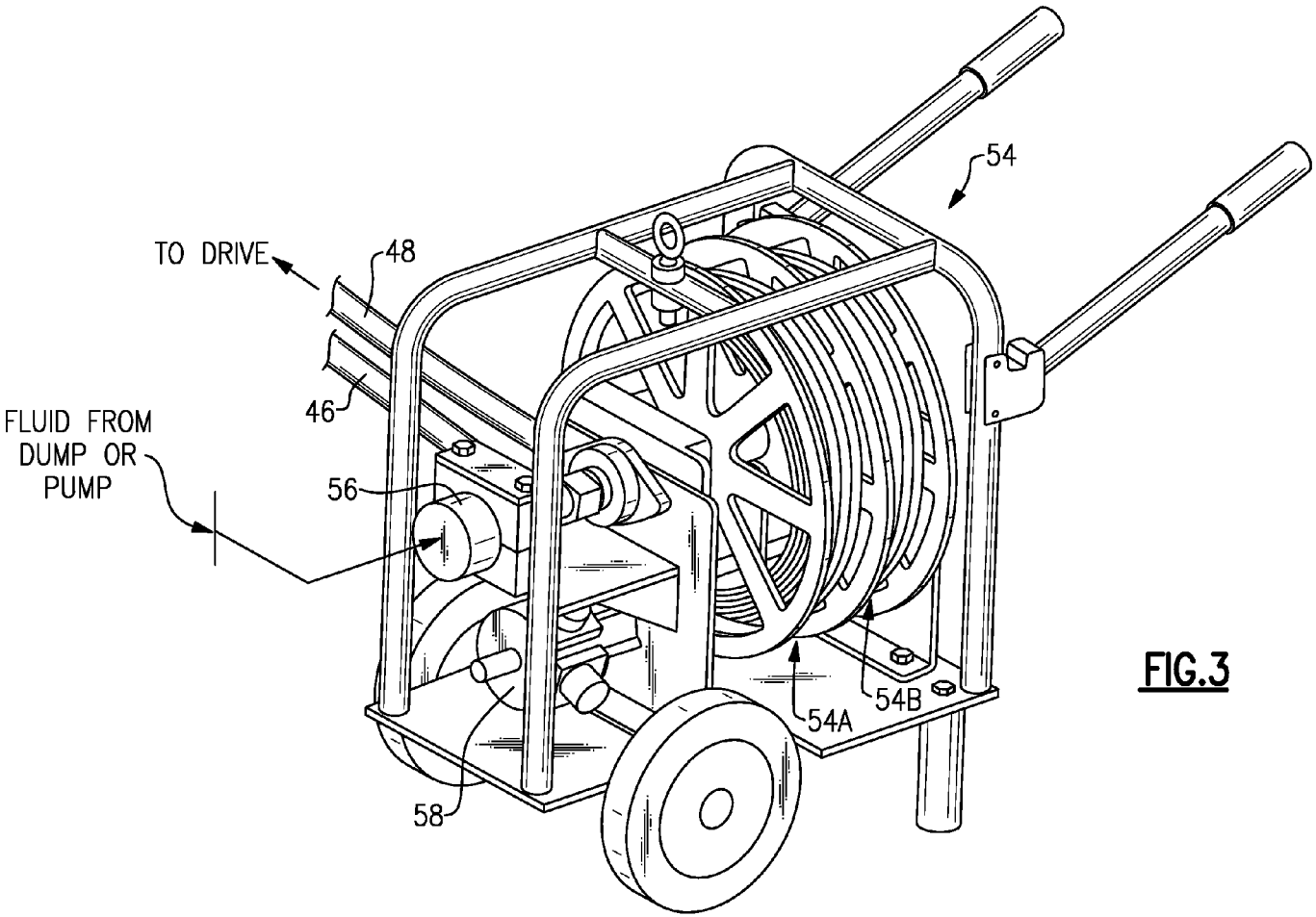
FIG. 3 illustrates an example reel assembly.

The reel 54, in one example, may provide a constant pressure to spool sections 54A, 54B to urge the spool sections 54A, 54B in a rotational direction that reduces (i.e., takes up) the slack 52 in the lances 46, 48. In one example, this constant pressure is provided by an air radial motor 58 (FIG. 3). The belt drive system 50 overcomes the urging of the reel 54 against the lances 46, 48 when moving the lances 46, 48 into the heat exchanger 30. Then, as the lances 46, 48 move out of the heat exchanger 30, the reel is configured to wind the lances 46, 48 back over the spool sections 54A, 54B.

The reel 54 in one example includes a swivel seal 56, illustrated in FIG. 3, configured to provide a high pressure fluid to the lances 46, 48 which are wrapped around the spool sections 54A, 54B. In one example, the swivel seal 56 is a hose swivel. Further, in the example where the lances 46, 48 travel within a flexible conduit, the flexible conduit may terminate adjacent the reel 54, such that the lances 46, 48 are wrapped around the spool sections 54A, 54B without the conduit.

Figure 4:
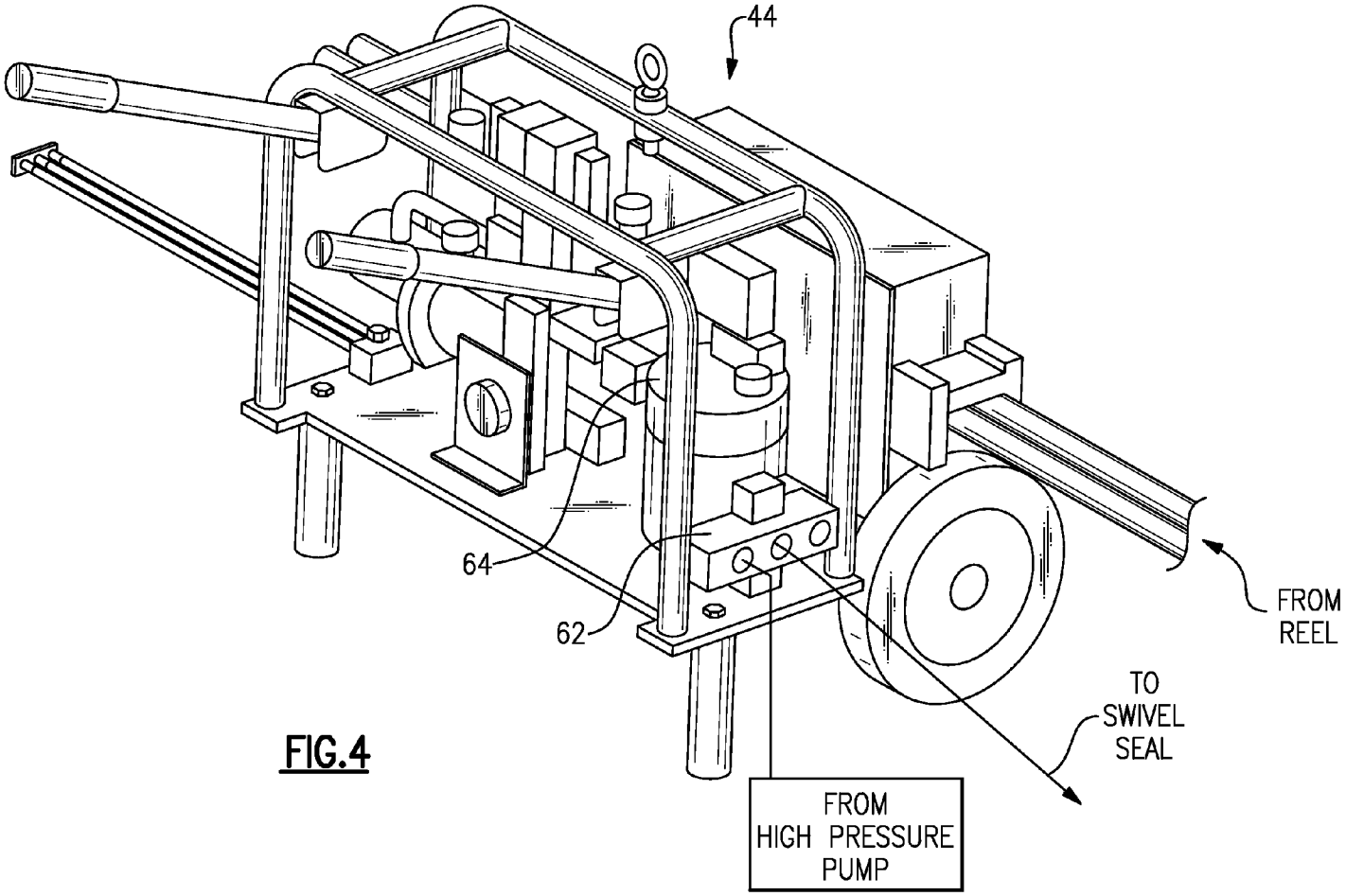
FIG. 4 illustrates an example drive system.

In one example, the high pressure fluid is sourced from a pump 21 connected to the drive system 44, as illustrated in FIG. 4. The pump 21 communicates a high pressure fluid to a manifold 62. The manifold 62 is mounted to a dump valve 64 configured to release high pressure fluid to the lances, or to atmospheric pressure, upon receiving a pneumatic control signal from an operator. While the dump valve 64 could be located elsewhere, it may be desirable to position the dump 64 on the drive system 44, especially in examples where the reel 54 is not included. The operator 38 can activate the dump valve 64 via the controller 42 (e.g., illustrated as a "DUMP" control). The manifold 62 is in turn in fluid communication with the swivel seal 56, and is configured to provide fluid to the swivel seal 56 from either the pump 62 and/or the dump valve 64 (depending on whether the dump valve 64 is activated).

At least some examples of the cleaning system 26 may be fully controlled by an operator positioned remotely from the cleaning system 26, at a safe distance away from the high pressures within the cleaning system 26, and without having to manually manage the slack in the lances.

While the reel 54 and X-Y positioning 32 system are illustrated in the Figures, some examples may exclude one of the reel 54 and the X-Y positioning system (e.g., depending on customer preferences). These examples still benefit from increased safety and reduced manpower requirements relative to systems lacking both an X-Y positioning system and a reel.

Figure 5:
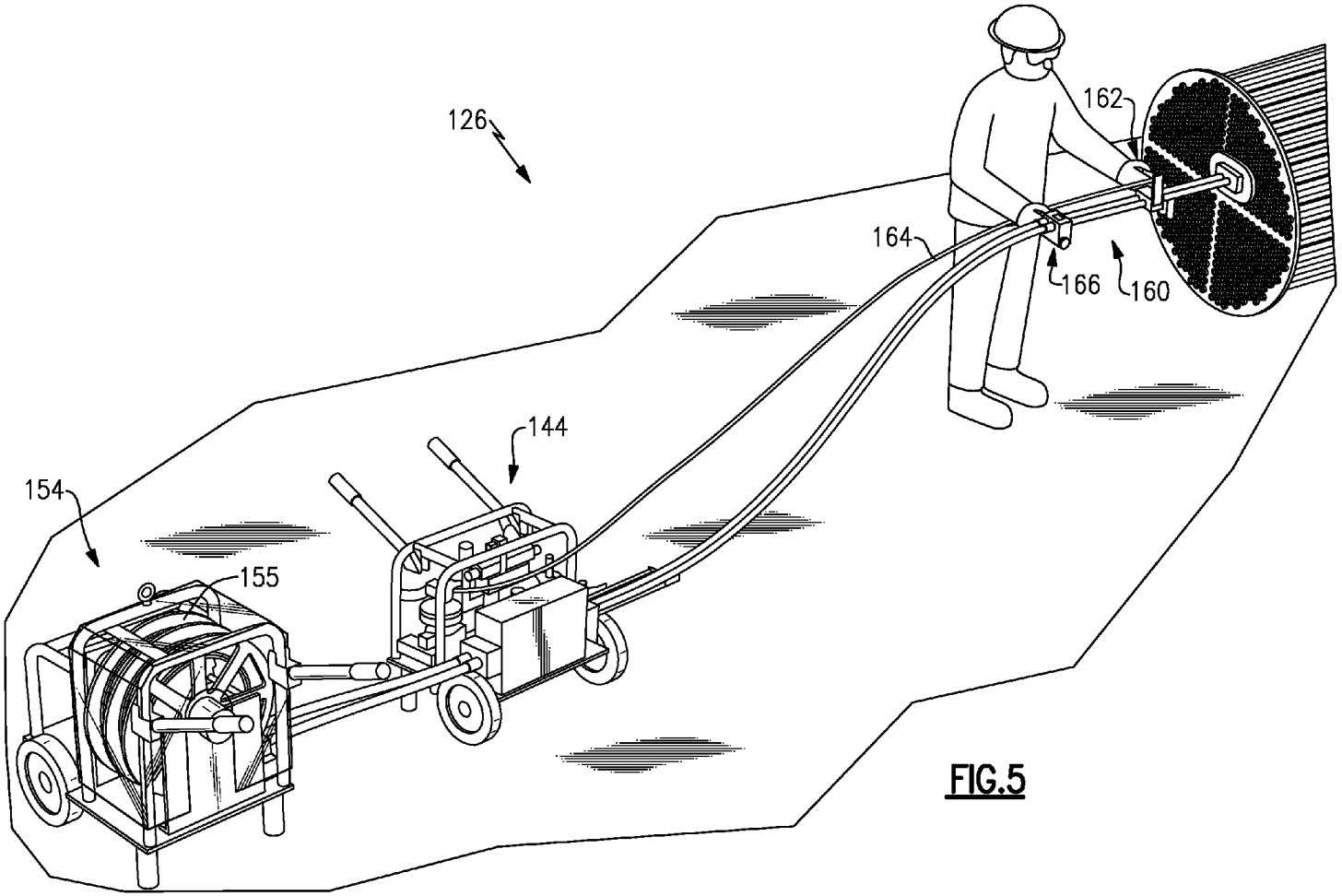
FIG. 5 illustrates a second example cleaning system.

For instance, FIG. 5 illustrates a second example automated cleaning system 126 which excludes an X-Y positioner. The elements in FIG. 5 are substantially the same as in the prior example except where expressly described, and are preappended with a "1." The system 126 includes a reel 154, a drive system 144, and a hand held lance guide 160. The lance guide 160 includes a first handle 162 which includes at least one trigger for sending pneumatic signals along at least one line 164 (only one illustrated) to actuate the drive belt system and the dump valve. The lance guide 160 further includes a second handle 166 for additional support. The conduit C terminates at fittings adjacent the second handle 166, and the flexible lances continue on toward, and into, the tubes of the heat exchanger, as in the prior example.

Figure 6A:
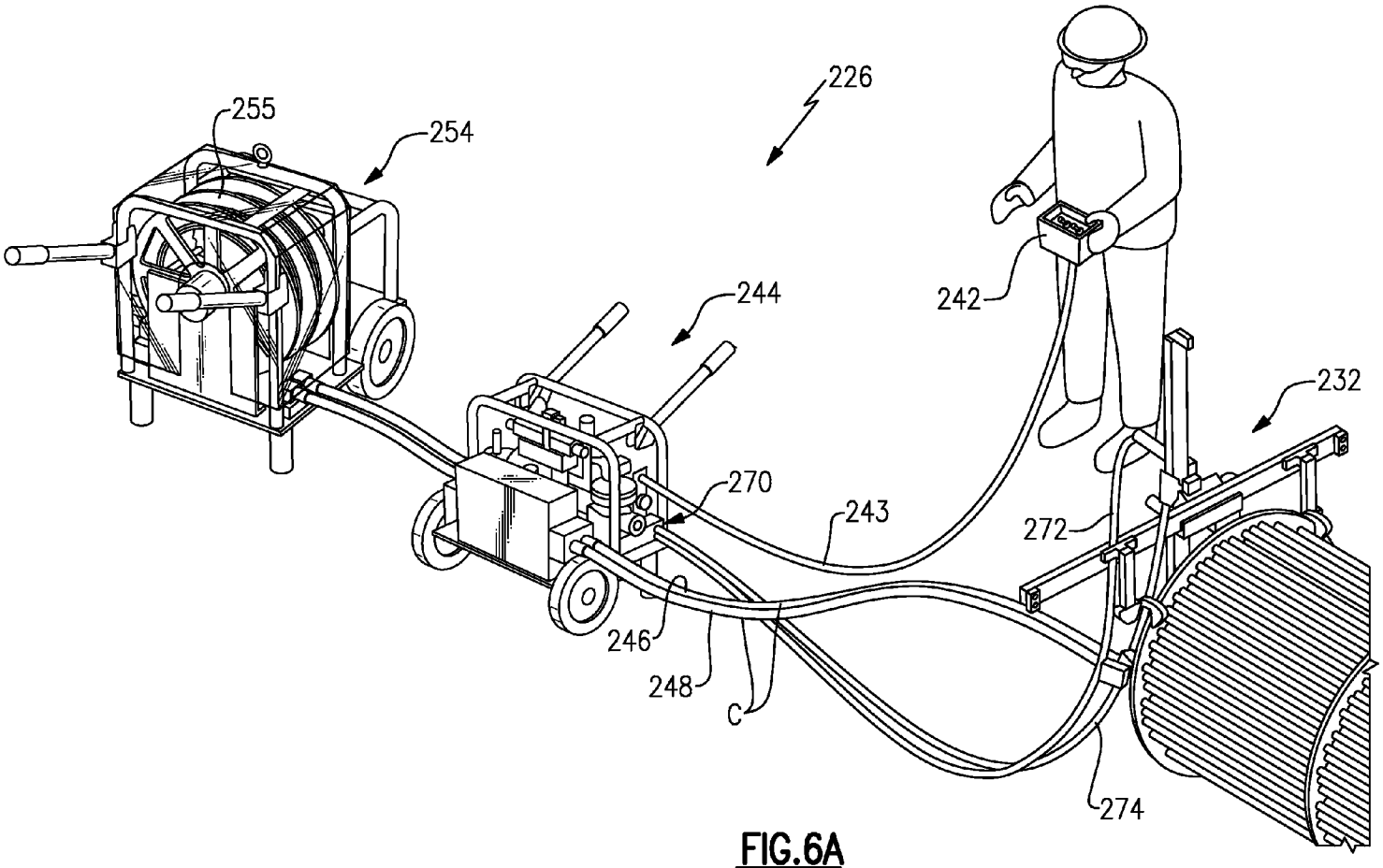
FIG. 6A illustrates a third example cleaning system.

FIG. 6A illustrates a third example automated cleaning system 226 which includes a different X-Y positioner 232 from the example of FIG. 2. The elements in FIG. 6A are substantially the same as in the prior examples except where expressly described, and are preappended with a "2." In FIG. 6A, the X-Y positioner 232 (FIG. 6B) is controlled by the remote control 242, which is connected, via a line 243, to a valve assembly 270 (FIG. 6C). The valve assembly 270, in turn, is in communication with two lines 272, 274, which are connected to the Y and X-actuators 276, 278 of the X-Y positioner 232, respectively.

Figure 6B:
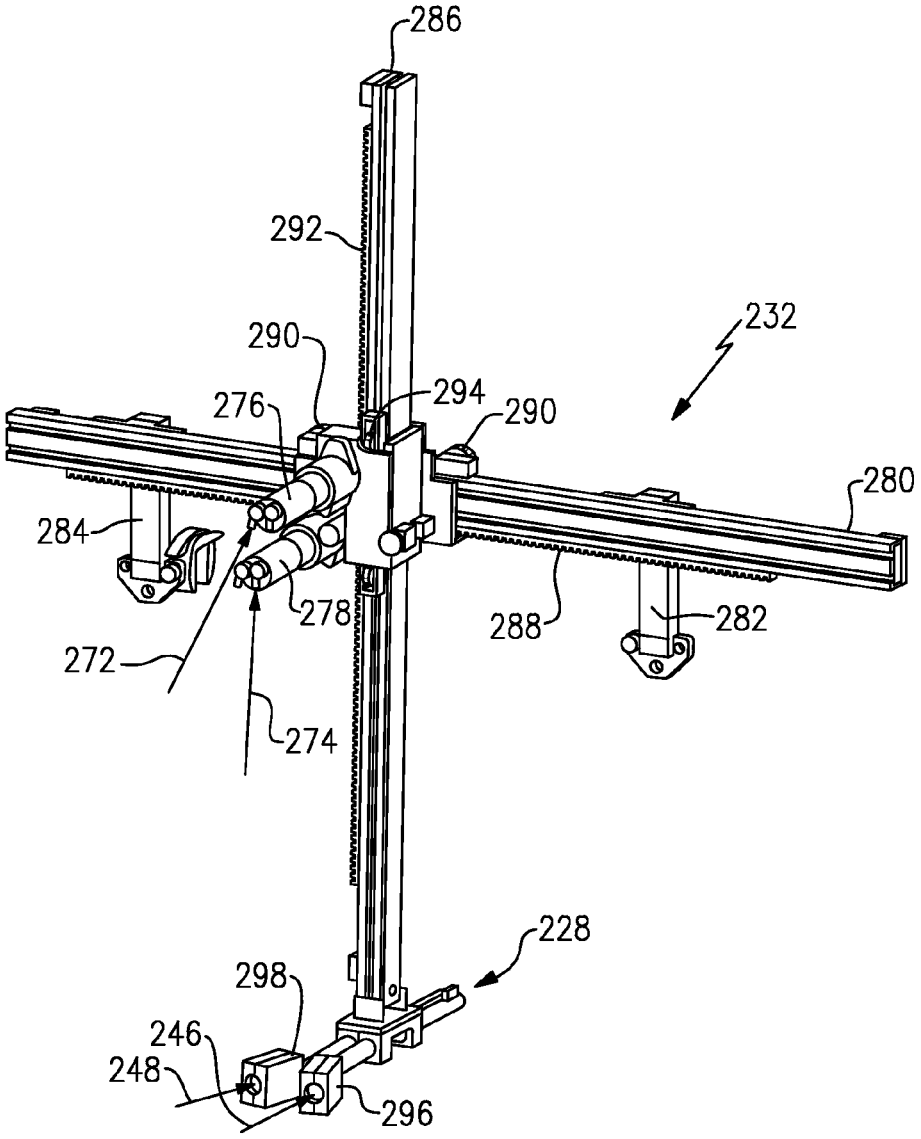
FIG. 6B illustrates the X-Y positioner of the cleaning system of FIG. 6A.
Figure 6C:
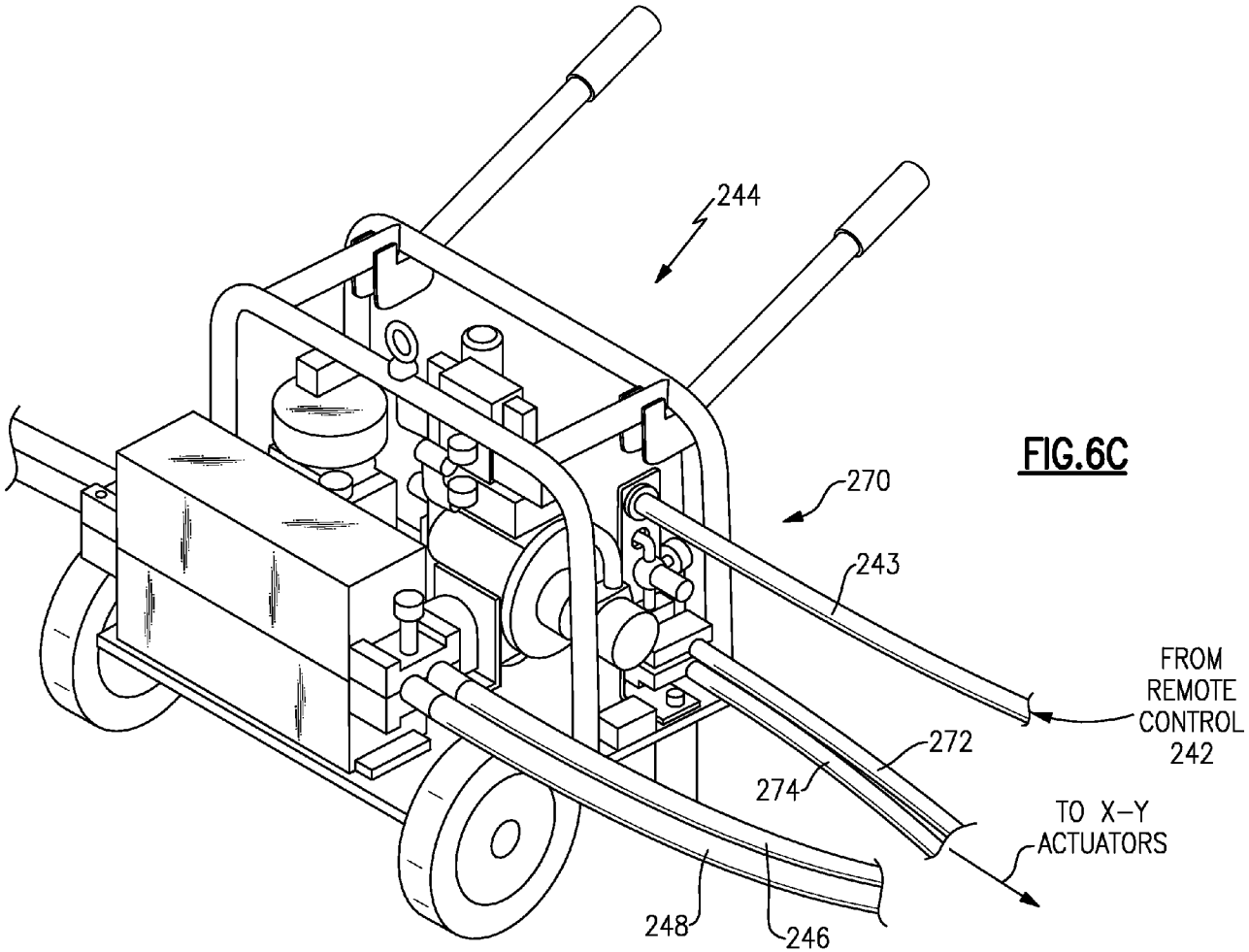
FIG. 6C illustrates the valve assembly of the cleaning system of FIG. 6A.

FIG. 6B illustrates the detail of the X-Y positioner 232. As illustrated, an X-support 280 is configured to be attached to an element to be cleaned via flanges 282, 284. The X-actuator 278 is mounted relative to the X-support 280 and is configured to move a Y-support 286 horizontally left and right (relative to FIG. 6B) along a track 288 mounted to the X-support 280. In this example, rollers 290 guide the Y-support 286 along the X-support 280. The Y-support 286, in turn, is movable vertically up and down relative to the X-support 280 via the Y-actuator 276. The Y-actuator 276 is in communication with a track 292 and rollers 294.

The X and Y-actuators 278, 276 are operable to change the position of the lance guide 228. As schematically illustrated, the lances 246, 248 are directed through first and second fittings 296, 298 in the guide 228, while the conduits protecting the lances 246, 248 terminate at the fittings 296, 298.

While not necessary in all examples, the reel may include a protective shield 155, 255 (FIGS. 5 and 6A). The shield 155, 255 prevents unwanted contact with the reel (e.g., prevents debris, or an operator from interfering with the reel).

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. An automated cleaning system, comprising:
an X-Y positioning system configured to position a lance guide relative to an element to be cleaned, wherein the X-Y positioning system is remotely operated;
a lance in communication with the lance guide;
a drive system configured to drive the lance relative to the element to be cleaned;
a reel configured to manage a slack in the lance, further wherein the reel is configured to manage the slack without manual input; and
wherein the X-Y positioning system includes a vertical support extending in a vertical direction and a horizontal support extending in a horizontal direction substantially perpendicular to the vertical direction, wherein the lance guide is fixedly attached to the vertical support, and wherein the horizontal support is fixedly attached to the element to be cleaned.

2. The system as recited in claim 1, further comprising a high pressure fluid source, the lance communicating fluid from the high pressure fluid source to the lance guide.

3. The system as recited in claim 2, wherein the high pressure fluid source includes a pump.

4. The system as recited in claim 3, wherein the pump is connected to the drive system.

5. The system as recited in claim 3, wherein the pump communicates fluid to a manifold, the manifold mounted to a dump valve operable to selectively direct fluid from the pump to one of the lance and atmospheric pressure.

6. The system as recited in claim 5, wherein fluid is communicated through the dump valve to atmospheric pressure when actuated by an operator.

7. The system as recited in claim 5, wherein an operator selectively routes fluid to one of the lance and the dump valve via a remote control.

8. The system as recited in claim 5, wherein the fluid is communicated to the lance by way of a swivel seal.

9. The system as recited in claim 8, wherein the swivel seal is mounted to the reel.

10. The system as recited in claim 1, wherein the reel includes a spool, and wherein at least a portion of the lance is wrapped around the spool, the spool being urged in a rotational direction such that the spool reduces slack in the lance.

11. The system as recited in claim 10, wherein the spool is urged in the rotational direction by an air radial motor.

12. The system as recited in claim 1, wherein the element to be cleaned is a heat exchanger includes a plurality of tubes.

13. The system as recited in claim 12, wherein the horizontal support is fixedly attached to the heat exchanger via a plurality of attachment flanges projecting from the horizontal support.

14. The system as recited in claim 1, further comprising a remote control, wherein the remote control pneumatically communicates with the X-Y positioning system.

15. The system as recited in claim 14, wherein the X-Y positioning system includes an X-actuator and a Y-actuator, wherein the X-actuator is configured to move the vertical support in the horizontal direction along the horizontal support, and wherein the Y-actuator is configured to move the vertical support in the vertical direction relative to the horizontal support.

16. The system as recited in claim 15, wherein the horizontal support includes a track and the vertical support includes a track, the tracks of the horizontal and vertical supports facilitating movement of the vertical support in the horizontal and vertical directions.

17. The system as recited in claim 15, wherein the horizontal support remains fixed as the vertical support moves in either of the horizontal or vertical directions.

18. The system as recited in claim 1, further comprising a first lance and a second lance in communication with the lance guide.

19. An automated cleaning system, comprising:

a lance guide;

a lance in communication with the lance guide;

a drive system configured to drive the lance relative to an element to be cleaned;

a reel configured to manage a slack in the lance, further wherein the reel is configured to manage the slack without manual input;

a high pressure fluid source including a pump, the lance communicating fluid from the high pressure fluid source to the lance guide; and an X-Y positioning system configured to position the lance guide relative to the element to be cleaned by moving the lance guide in a horizontal direction and a vertical direction substantially perpendicular to the horizontal direction, the X-Y positioning system including a vertical support and a horizontal support extending respectively in the vertical and horizontal directions, wherein the lance guide is fixedly attached to one of the vertical support and the horizontal support, wherein the one of the vertical support and the horizontal support is configured to move in both the vertical direction and the horizontal direction relative to the other of the vertical support and the horizontal support, and wherein the other of the horizontal support and the vertical support is fixedly attached to the element to be cleaned and does not move relative to the element to be cleaned during operation of the X-Y positioning system.

20. The system as recited in claim 19, wherein the pump is connected to a dump valve mounted to the drive system.

* * * * *